US010859350B1

(12) United States Patent
Arnon

(10) Patent No.: US 10,859,350 B1
(45) Date of Patent: Dec. 8, 2020

(54) METHOD OF SEALING AND SECURING A SHAPED CHARGE

(71) Applicant: Harry Arnon, Sanford, FL (US)

(72) Inventor: Harry Arnon, Sanford, FL (US)

(73) Assignee: Hernon Manufacturing, Inc., Sanford, FL (US)

( * ) Notice: Subject to any disclaimer, the term of this patent is extended or adjusted under 35 U.S.C. 154(b) by 0 days.

(21) Appl. No.: 16/209,318

(22) Filed: Dec. 4, 2018

Related U.S. Application Data

(60) Provisional application No. 62/594,060, filed on Dec. 4, 2017.

(51) Int. Cl.

| | |
|---|---|
| ***F42B 12/82*** | (2006.01) |
| ***F42B 1/028*** | (2006.01) |
| ***F42B 3/26*** | (2006.01) |
| ***F42B 3/10*** | (2006.01) |
| ***F42B 1/036*** | (2006.01) |
| ***F42B 12/10*** | (2006.01) |

(52) U.S. Cl.
CPC ..... *F42B 1/028* (2013.01); *F42B 1/036* (2013.01); *F42B 3/10* (2013.01); *F42B 3/26* (2013.01); *F42B 12/10* (2013.01); *F42B 12/82* (2013.01)

(58) Field of Classification Search
CPC ..... F42B 12/80; F42B 12/82; F42B 12/10; F42B 12/14; F42B 12/18; F42B 1/028; F42B 3/26; F42B 3/10
See application file for complete search history.

(56) References Cited

U.S. PATENT DOCUMENTS 3,276,369 A * 10/1966 Bell ..... F42B 3/08 102/306
3,347,164 A * 10/1967 Name not available ..... E21B 43/117 102/310
3,650,212 A * 3/1972 Bauer ..... E21B 43/117 102/310
6,179,944 B1 * 1/2001 Monolo ..... B29C 53/585 102/473
6,644,206 B2 * 11/2003 Fogle, Jr. ..... B60R 21/2644 102/530

* cited by examiner

*Primary Examiner* — Stephen Johnson
(74) *Attorney, Agent, or Firm* — Allen Dyer Doppelt & Gilchrist, PA

(57) ABSTRACT

A method of sealing and securing of a shaped charge comprising a casing having a detonator, an explosive filler disposed within the casing having a cavity formed therein, and a liner disposed over the explosive filler. The method includes coating at least one portion of the shaped charge with a curable sealant, and exposing the curable sealant to radiation to cure the curable sealant. The radiation may be in the ultraviolet range and have a wavelength in a range of from about 200 to about 400 nanometers. In addition, the at least one portion of the shaped charge that is coated with the curable sealant may be a surface of the liner, a joint between the liner and the casing, over the detonator, or any combination thereof. The liner may comprise a metallic liner.

6 Claims, 2 Drawing Sheets

METHOD OF SEALING AND SECURING A SHAPED CHARGE

CROSS-REFERENCE TO RELATED APPLICATION

This application claims the benefit of U.S. Provisional Patent Application Ser. No. 62/594,060, filed on Dec. 4, 2017, the contents of which application are herein incorporated by reference in their entirety.

FIELD OF THE INVENTION

The present invention relates to shaped charges, and more particularly, to a method of sealing and securing shaped charges.

BACKGROUND OF THE INVENTION

Traditionally, shaped charges, or hollow Munroe Effect charges, were designed for military uses, such as cutting bridge metal or attacking tanks or concrete structures. Recent commercial use of shaped charges in the petroleum production industry has overtaken military uses of the technology by using multiple radially mounted charges fired simultaneously to perforate the well on completion of drilling. This is known as a well perforating gun.

A typical shaped charge includes a casing having a cylinder of explosive filler with a conical hollow portion covered by a metal liner in one end and a central detonator or detonation wave guide at the other end. Additional internal structures, such as shock amplification or blast wave shapers, can be attached to the explosive filler, casing or liner. A detonation wave from the point of origin moves forward over the conical hollow portion and compresses the metal forward at extremely high speeds and into an extended rod or jet of the liner material. The depth of penetration varies with the construction of the shaped charge and the material into which it is detonated. In commercial use, small-diameter charges of a well perforating gun are detonated to perforate cement well liners and the surrounding rock in order to promote the flow of petroleum products or to enable fluid injection for maximum recovery.

These shaped charges of the well perforating gun must be able to withstand high pressures in a well and high temperatures in the shaft around them. It is essential to prevent the contamination of the shaped charges and the firing train during lowering into a shaft of the well. The electrical firing mechanisms must all detonate at once to prevent destruction of a reusable well perforating gun and damage to the well due to asymmetrical pressure waves.

Previous methods of sealing the liner of a shaped charge have included lacquer and silicone sealants, O-rings, threads, mechanical seals, and even all-welded enclosures. Many of these materials are not reusable or reloadable or effective at all at the pressures and temperatures to be withstood. Further improvements are possible.

SUMMARY OF THE INVENTION

In view of the foregoing, it is an object of the present invention to provide an improved method for sealing and securing a shaped charge. According to an embodiment of the present invention, a method of sealing and securing a shaped charge is disclosed. The shaped charge includes a casing having a detonator, an explosive filler disposed within the casing having a cavity formed therein, and a liner disposed over the explosive filler. The method includes coating at least one portion of the shaped charge with a curable sealant, and exposing the curable sealant to radiation to cure the curable sealant.

The radiation may be in the ultraviolet range and have a wavelength in a range of from about 200 to about 400 nanometers. In addition, the at least one portion of the shaped charge that is coated with the curable sealant may be a surface of the liner, a joint between the liner and the casing, over the detonator, or any combination thereof. The liner may comprise a metallic liner.

According to another aspect of the invention, a shaped charge is disclosed. The shaped charge includes a casing having a detonator, an explosive filler disposed within the casing having a cavity formed therein, a liner disposed over the explosive filler, and a curable sealant coating at least one portion of the shaped charge, where the curable sealant having been exposed to radiation in order to cure.

According to another aspect of the invention, a well perforating gun is disclosed. The well perforating gun includes a tubular housing, and a plurality of shaped charges within the housing. Each of the shaped charges includes a casing having a detonator, an explosive filler disposed within the casing having a cavity formed therein, a liner disposed over the explosive filler, and a curable sealant coating at least one portion of the shaped charge, where the curable sealant having been exposed to radiation in order to cure.

These and other objects, aspects and advantages of the present invention will be better appreciated in view of the drawings and following detailed description of preferred embodiments.

DETAILED DESCRIPTION OF PREFERRED EMBODIMENTS

Figure 1:
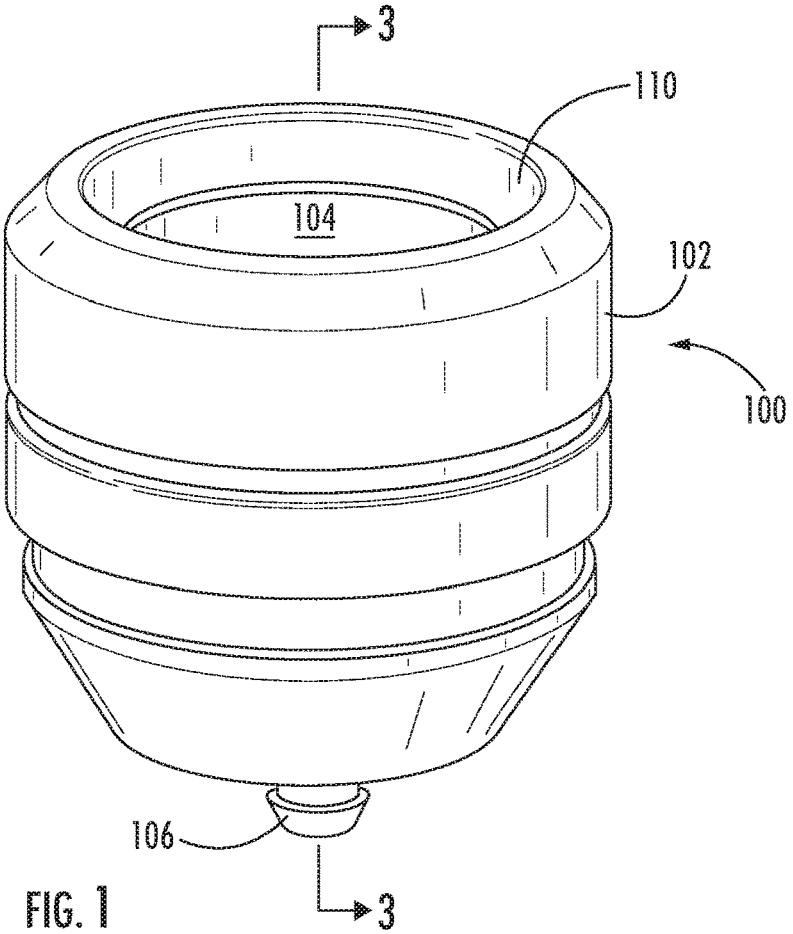
FIG. 1 is a perspective view of a shaped charge, according to an aspect of the present invention.

In the summary of the invention, provided above, and in the descriptions of certain preferred embodiments of the invention, reference is made to particular features of the invention, for example, method steps. It is to be understood that the disclosure of the invention in this specification includes all possible combinations of such particular features, regardless of whether a combination is explicitly described. For instance, where a particular feature is disclosed in the context of a particular aspect or embodiment of the invention, that feature can also be used, to the extent possible, in combination with and/or in the context of other particular aspects and embodiments of the invention, and in the invention generally.

Referring now to FIG., a shaped charge 100 in accordance with the invention is illustrated. The shaped charge 100 includes a casing 102 having a detonator 106 at a first end, and a liner 104 disposed over an explosive filler 112 (shown in FIG. 3) disposed within the casing 102 having a cavity formed therein at a second end. The liner 104 may be a metal liner.

Figure 2:
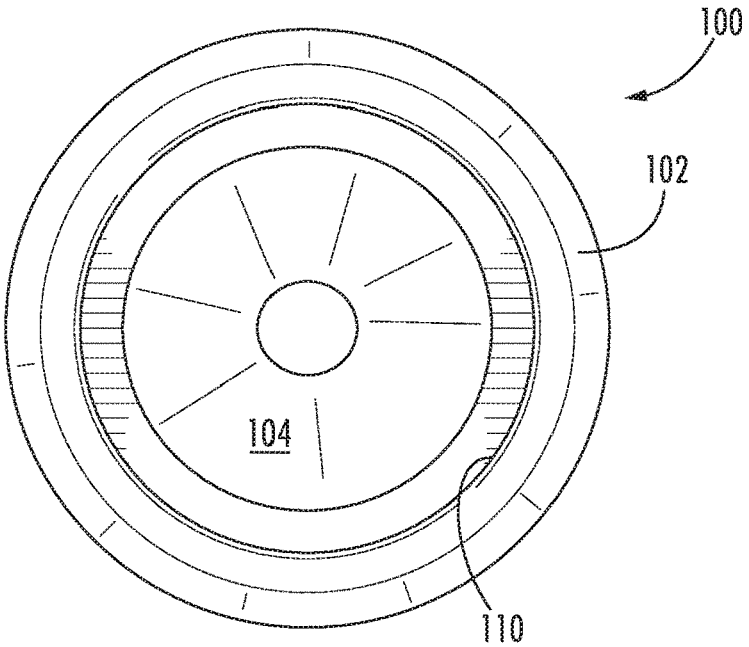
FIG. 2 is a top view of the shaped charge of FIG. 1.
Figure 3:
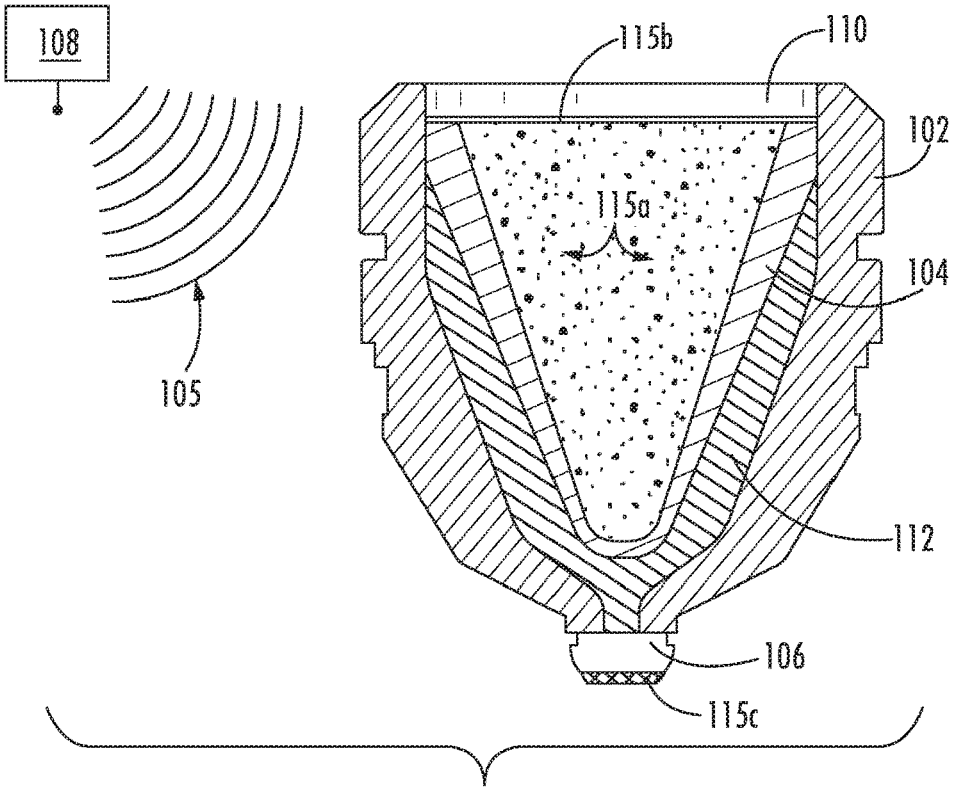
FIG. 3 is a cross sectional view of the shaped charge of FIG. 1 taken in the direction of line 3-3.

The present invention includes a sealant 115*a*, 115*b*, 115*c* that is applied to the shaped charge 100 at various critical areas as shown in FIGS. 2 and 3. The sealant 115*a*, 115*b*, 115*c* has properties to bond to different components of the shaped charge 100 in order to strengthen the integral structure and pressure penetration resistance of the shaped charge 100. The sealant 115*a*, 115*b*, 115*c* can be cured in seconds, leading to high speed production and inline quality control inspection.

According to one embodiment of the present invention, the sealant 115*a*, 115*b*, 115*c* may be applied to the exterior of an individual component of the shaped charge 100, a fully assembled shaped charge 100, or any sub-assembly thereof, including subsequent assembly of previously sealed and bonded sub-components. The sealant 115*a*, 115*b*, 115*c* may penetrate all areas of the shaped charge 100 due to its low viscosity and thus achieve an airtight seal.

For example, the sealant 115*a* may be applied over the liner 104. In addition, the sealant 115*b* may be applied in the joint between the open end of the casing 102 and the rim 110 at the outer end of the liner 104, and/or the sealant 115*c* may be applied over the detonator 106 and the casing 102 of the shaped charge 100, as shown in FIGS. 2 and 3. The sealant 115*a*, 115*b*, 115*c* will reach all juncture areas between each area of every component to which it is applied. The present invention is not limited to the application of sealant 115*a*, 115*b*, 115*c* to only those areas described herein, but is intended to be exemplary only, with a true scope and spirit of the invention being indicated by the following claims.

After the sealant 115*a*, 115*b*, 115*c* is applied to the shaped charge 100, radiation 105 of certain spectral properties and characteristic intensity is applied for a duration of time to cure the sealant 115*a*, 115*b*, 115*c*. The radiation 105 is of spectral and intensity characteristics appropriate to the curing of the sealant 115*a*, 115*b*, 115*c*. For example, this may be radiation 105 in the visible, ultraviolet, UV-visible, infrared, microwave or other appropriate spectral regime.

In one aspect of the invention, the radiation 105 is ultraviolet light having a wavelength in a range of from about 200 to about 400 nanometers. However, the radiation 105 employed in the general practice of the invention can be of any suitable type for the particular sealant 115*a*, 115*b*, 115*c* being applied.

The radiation source 108 to supply the curing radiation 105 to the sealant 115*a*, 115*b*, 115*c* may include lamps, LEDs, photoluminescent media, down-converting and up-converting materials that respond to incident radiation in one electromagnetic spectral regime and responsively emit radiation of a longer or shorter wavelength, respectively, electro-optical generators, lasers, and the like. In instances where the sealant 115*a*, 115*b*, 115*c* includes UV-curable resin, the radiation source 108 can be an ultraviolet lamp, for example.

The sealant 115*a*, 115*b*, 115*c* functions both as a barrier to water or contaminant intrusion and a structural seal for components. The explosive filler 112 and the liner 104, or any other component of the shaped charge 100, can thus be unitized permanently and simultaneously sealed against chemical and water intrusion when deeply submerged.

The area of the seal that is exposed at the rim 110 of the shaped charge 100 can also be marked by laser, dot-matrix printing or some other method of encoding production information into the sealant 115*a*, 115*b*, 115*c* without damaging either the quality of the seal or the shaped charge components for inventory control and traceability.

The area of the wiring of the firing mechanism (e.g., detonator 106) may be secured and sealed by the application of the sealant 115*c* as shown in FIG. 3, with identical clearances for the achievement of optimum penetration of the sealant 115*c* and UV radiation 105 for curing. This is intended to prevent the fouling of the firing mechanism 106 by penetration by water or chemicals, and the releasing of the connector in imbalances of multiple charges or very short interval delays in the firing of the shaped charges 100, if any, that may occur.

The application of sealant 115*a*, 115*b*, 115*c* may provide an intensity and focus of blast with extraordinary levels of pull or shear strength, for example, as strong as 4,000 or more pounds of force. The sealant 115*a*, 115*b*, 115*c* prevents the liner 104 and the case 102 from separating for very small increments of time, increasing the directional blast generated by the shaped charge 100. The greater power of shaped charge 100 thus achieved can allow smaller amounts of expensive explosive filler 112 or liner 104 material to be used to achieve the same effect as previous charges and thus reduce cost.

Due to the greater bonding potential of the sealant 115*a*, 115*b*, 115*c* in joining elements together, there is greater freedom to design ways to reduce or eliminate threading or other fastener securement; there is virtually no difference in retention strength. The use of sealant 115*a*, 115*b*, 115*c* can thus increase the areas where the explosive filler 112 or liner 104 may be inserted in a shaped charge 100 and thus achieve greater penetration for a given size of envelope.

Figure 4:
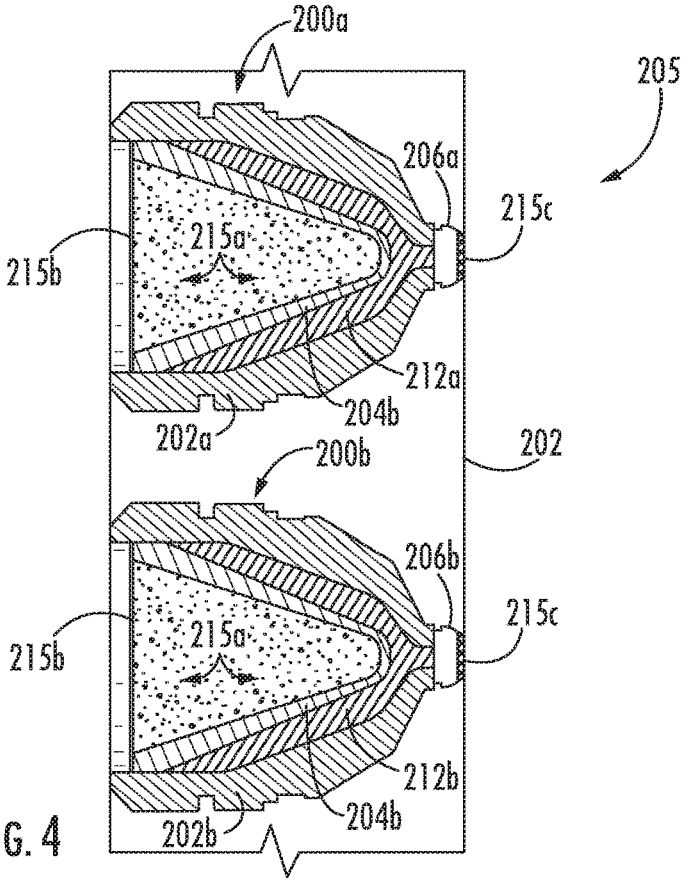
FIG. 4 is a partial cross sectional view of a well perforating gun having shaped charges, according to an aspect of the invention.

For example, when a 30-mm diameter charge is increased to 34 mm, deeper penetration is expected due to greater cross-sectional area (706 sq. mm v. 907 sq. mm) for forming the rod or jet and a greater explosive filler charge is possible. Similar power to that currently possible can thus be achieved in a smaller shaped charge package, further increasing the efficiency of blasts by offering a smaller well perforation gun 205 to improve standoff for the shaped charges 200*a*, 200*b* as shown in FIG. 4 in cross section.

The well perforation gun 205 includes a tubular housing 202, and a plurality of shaped charges 200*a*, 200*b* in a desired orientation with one above the other within the housing 202. Each of the shaped charges 200*a*, 200*b* includes a respective casing 202*a*, 202*b* having a detonator 206*a*, 206*b*. The shaped charges 200*a*, 200*b* each include an explosive filler 212*a*, 212*b* disposed within the respective casing 202*a*, 202*b* having a cavity formed therein. In addition, a respective liner 204*a*, 204*b* is disposed over the explosive filler 212*a*, 212*b* and a curable sealant 215*a* coating the respective liner 204*a*, 204*b*, where the curable sealant 215 exposed to radiation 105 in order to cure.

Thus, in a particular aspect the present invention may be used for sealing of shaped charge elements such as liners, firing trains, detonators, fuses, and/or igniters and with or without boosters, each to the other, to one another and/or to seal them within the well perforation gun structure 205.

The sealant 115*a*, 115*b*, 115*c* may withstand push or pull forces of 4,000 pounds, equivalent to immersion under 9,007 feet of salt water, and more sealants to handle even higher pressures will be advanced along the same lines of development. Military uses of the shaped charges 100 stand to benefit from the use of viscous, penetrating sealants 115*a*, 115*b*, 115*c* that can impart high structural bonding strength, as these shaped charges 100 are regularly exposed to rugged combat conditions. The sealants 115*a*, 115*b*, 115*c* referenced herein may routinely withstand very high temperatures without damage.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A shaped charge comprising:

a casing having a detonator, the casing having a first end and a second end, the detonator being located at the first end and the second end being open;

an explosive filler disposed within the casing having a cavity formed therein, the cavity extending inwardly from the second end of the casing;

a liner disposed in the cavity over the explosive filler, a joint being formed between the casing and an outer end of the liner at the second end of the casing; and a curable sealant coating at least one portion of the shaped charge, the curable sealant exposed to radiation in order to cure;

wherein the at least one portion of the shaped charge that is coated with the curable sealant is the joint between the outer end of the liner and the second end of the casing.

2. The shaped charge of claim 1, wherein the radiation is ultraviolet radiation.

3. The shaped charge of claim 1, wherein the radiation has a wavelength in a range of from about 200 to about 400 nanometers.

4. The shaped charge of claim 1, wherein the at least one portion of the shaped charge that is coated with the curable sealant also includes a surface of the liner.

5. The shaped charge of claim 1, wherein the at least one portion of the shaped charge that is coated with the curable sealant also includes an area over the detonator.

6. The shaped charge of claim 1, wherein the liner comprises a metallic liner.

* * * * *